United States Patent [19]

Weinstein

[11] 4,354,638

[45] Oct. 19, 1982

[54] SPIRAL ACTUATOR FOR AEROSOL POWDERED SUSPENSION PRODUCT

[75] Inventor: Jack Weinstein, Old Bridge, N.J.

[73] Assignee: Bristol-Myers Company, New York, N.Y.

[21] Appl. No.: 143,404

[22] Filed: Apr. 25, 1980

[51] Int. Cl.[3] ..... B05B 7/32

[52] U.S. Cl. ..... 239/337; 222/402.1; 222/547; 239/579; 239/590

[58] Field of Search ..... 239/337, 486, 487, 542, 239/590, 600, 579; 222/146 HA, 146 HS, 146 HE, 146 H, 402.1, 547, 564

[56] References Cited

U.S. PATENT DOCUMENTS

| | | | |
|---|---|---|---|
| 1,485,143 | 2/1924 | Mobley | 239/486 |
| 2,908,446 | 10/1959 | Strouse | 239/573 |
| 2,968,441 | 1/1961 | Holcomb | 239/337 |
| 3,088,682 | 5/1963 | Venus, Jr. | 239/573 |
| 3,108,590 | 10/1963 | Gorman . | |
| 3,116,856 | 1/1964 | Prussin et al. | 222/394 |
| 3,146,916 | 9/1964 | Kronheim | 222/182 |
| 3,148,806 | 9/1964 | Meshberg | 222/394 |
| 3,154,075 | 10/1964 | Weckesser . | |
| 3,178,120 | 4/1965 | Kappel | 239/337 |
| 3,186,645 | 6/1965 | Eberlein | 239/567 |
| 3,216,628 | 11/1965 | Fergusson | 222/394 |
| 3,236,458 | 2/1966 | Ramis | 239/338 |
| 3,292,823 | 12/1966 | Weidman et al. | 222/146 HA |
| 3,317,140 | 5/1967 | Smith | 239/337 |
| 3,369,756 | 2/1968 | Ramis | 239/338 |
| 3,472,457 | 10/1969 | McAvoy | 239/337 |
| 3,570,770 | 3/1971 | Ewald | 239/337 |
| 3,698,645 | 10/1972 | Coffey | 239/573 |
| 3,710,985 | 1/1973 | Baum | 222/146 HA |
| 3,722,753 | 3/1973 | Miles | 222/146 HA |
| 3,913,842 | 10/1975 | Singer | 239/337 |
| 4,030,667 | 6/1977 | Le Guillou | 239/573 |
| 4,061,252 | 12/1977 | Riccio | 222/402.18 |

FOREIGN PATENT DOCUMENTS

| | | | |
|---|---|---|---|
| 1206369 | 12/1965 | Fed. Rep. of Germany | 239/579 |

*Primary Examiner*—John J. Love
*Assistant Examiner*—Michael J. Forman
*Attorney, Agent, or Firm*—Irving Holtzman; George A. Mentis

[57] ABSTRACT

An actuator for an aerosol powdered suspension product in which an elongated spiral path is provided in the actuator head to reduce the "fogging" of the sprayed product.

8 Claims, 6 Drawing Figures

SPIRAL ACTUATOR FOR AEROSOL POWDERED SUSPENSION PRODUCT

FIELD OF INVENTION

This invention relates to an actuator for an aerosol container and is particularly useful in dispensing suspensions of powdered materials in an aerosol propellant from an aerosol can with a minimum of fogging.

Dispensing suspensions of active powdered materials e.g. antiperspirant materials from an aerosol container has proven to be a very convenient mode for the application of such materials. Moreover, the utilization of fluoro-carbon propellants in these systems became almost universal. However, with the advent of the concern of the effect of the fluorocarbon propellants on the atmosphere, the search began for substitute propellants.

The substitute propellants that suggested themselves were the hydrocarbon propellants i.e. the normally gaseous hydrocarbons. However, when the hydrocarbon propellants were used in place of the fluorocarbon propellants, certain undesired side effects were noted. This concerned the "fogging" of the product i.e. the formation of persistent mists of the product when it was sprayed from the aerosol can which fogging is directly related to the particle size of the sprayed product.

This effect is tied in with the expansion characteristics of hydrocarbon propellants when compared to those of fluorocarbon propellants. The low density of hydrocarbon propellants (i.e. 0.579 g/cc isobutane vs. 1.435 g/cc F12/F11 35/65) will result in 2.3 times greater vapor volume per gram of liquid hydrocarbon propellant than would be obtained with 1 g of liquid fluorocarbon propellant. The rapid, greater expansion of the hydrocarbon propellant upon leaving a pressurized package results in the formation of a significant number of small particles which tend to remain suspended in the air and thus available to possible inhalation.

It has now been found that by employing the novel actuator system described in more detail below to dispense suspensions of powdered materials e.g. antiperspirant materials in a propellant system, and especially in a hydrocarbon propellant system, provides a controlled expansion of the propellant prior to the product entering the ambient atmosphere. The net effect of this controlled expansion is the development of a lower velocity spray with larger particle size which tends to fall at a rapid pace rather than remain suspended in the air for possible inhalation. An addition positive effect noted with the proposed modification is the ability to spray products containing higher than normal proportion of solids without clogging the actuator button.

It is accordingly an object of the present invention to provide an actuator for a pressurized aerosol container that is designed to control and prevent the rapid expansion of the propellant contained in the aerosol container so that the powdered material that may be suspended in said propellant remains as relatively large particles rather than forming a mist.

It is a further object of the present invention to provide an article of manufacture that comprises a suspension of powdered material in a propellant contained in an aerosol can under pressure which is provided with an actuator designed to control and prevent the rapid expansion of the propellant and to provide a low velocity spray containing relatively large particles of powdered material which tend to settle rapidly.

It is a further object of the present invention to provide an article of manufacture as set forth in the above object wherein the propellant is a hydrocarbon propellant.

Other and more detailed objects of this invention will be apparent from the following description, drawings and claims.

DISCUSSION OF PRIOR ART

U.S. Pat. Nos. 4,061,252; 3,698,645 and 3,088,682 disclose the use of a single or multiple expansion chambers. The primary purpose of these expansion chambers as stated in these patents is to provide an improved mixing of the propellant and the liqud product and, therefore, enhance the breakup characteristics of the spray. The net result would be the delivery of a finer spray. In each of these patents, the expansion chambers have a spray nozzle at the exit point. As a result of the use of these nozzles, the internal pressures within the expansion chambers would be only slightly lower than the pressures within the aerosol can.

In U.S. Pat. No. 4,061,252 the portion referred to as expansion chamber 35 is in effect a mixing chamber for liquid product and gaseous propellant. The apparent objective is to improve the spray pattern by using a low pressure propellant such as butane and not to increase the droplet size of the product spray.

In U.S. Pat. No. 3,698,645, as in U.S. Pat. No. 4,061,252, the described expansion chamber 26 is intended to provide a more efficient mixing of propellant, liquid product and in this instance, disperse solid particles. The improvement sought by the mixing chamber 26 is the ability to dispense larger solid particles through a standard spray nozzle insert downstream. Again, the net effect is an improved mechanical mixing of propellant and product for a more efficient uniform spray pattern. Note lines 50 through 55, column 2, where it states "a fine spray is delivered through orifice 36".

U.S. Pat. No. 3,088,682 shows the use of alternating expansion chambers, the stated purpose of which is to help in the breakup of fluid particles to aerosol size at low pressure. This concept is similar in purpose to that described in U.S. Pat. No. 4,061,252.

In contrast with the above, in the actuator of the present invention, there is incorporated an open-ended expansion chamber wherein the pressure would be substantially lower than that within the can. The objective of this invention is not to improve the fineness of spray, but to deliver a softer spray at a lower velocity and incorporate particles of a larger size. These particles would therefore tend to fall at a rapid pace rather than remain suspended in the air for possible inhalation.

SUMMARY OF THE INVENTION

The objects of the present invention are obtained by providing an actuator for an aerosol container than is adapted to be mounted on the valve stem of the valve in an aerosol container. The actuator is provided with an inlet opening which is adapted to communicate with the opening in the aerosol valve stem and an outlet opening that is adapted to communicate with the atmosphere. Disposed within the body of said actuator and connecting said inlet and outlet openings is a helically shaped tubular member described in more detail below. This may be mounted on an aerosol can containing a powdered material e.g. antiperspirant material suspended in a propellant e.g. hydrocarbon propellant under pressure.

DETAILED DESCRIPTION OF INVENTION

The actuator of this invention can be used to replace the push button actuators or spray heads of most conventional aerosol spray dispensers, such as those described in U.S. Pat. Nos. 4,061,252 (Riccio); 3,698,645 (Coffey); 3,088,683 (Venus Jr.); 4,030,667 (Le Guilluo), the disclosures of which are incorporated herein by reference for their description of the valve mechanisms and other components of conventional aerosol spray dispensers.

In its preferred embodiment, the aerosol valve actuator body 1 (See FIG. 4) of this invention is formed of an inexpensive material such as plastic, for example, high, medium or low density polyethylene, polypropylene, or other suitable plastic which is inert to the material to be sprayed and is formed in two portions, upper portion 11 and lower portion 13 as shown in FIGS. 1 through 4.

Figure 1:
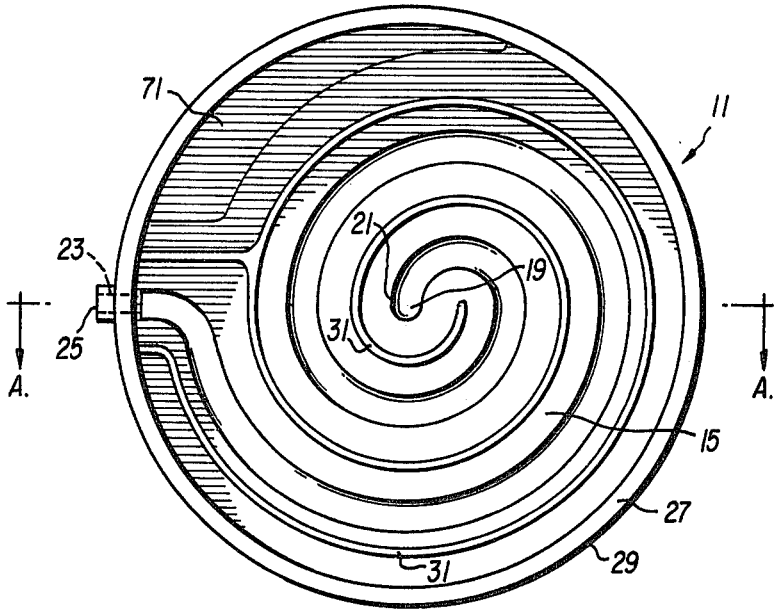
FIG. 1 is a plan view of the underside of the upper portion of an actuator embodied in the present invention.
Figure 2:
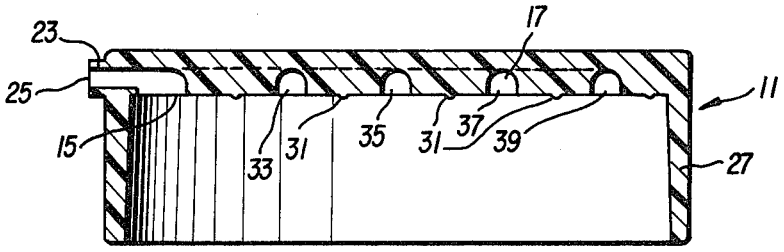
FIG. 2 is a longitudinal cross-sectional view of FIG. 1 taken along line A—A.

As shown in FIGS. 1 and 2, top portion 11 has a grooved surface 15 which is provided with a spiral groove 17. Although only two revolutions are shown, it is understood that a greater or lesser number of revolutions of the spiral groove may be used depending on such factors as the width of the grooves, the total volume of the groove, the pressure of the container, the type of and intended use of the product, etc. The groove 17 has an inlet end 19 which is located at a center axis 21 of the top portion 11. The groove terminates at exit orifice 25 bored through sidewall 23 of the top portion. The top portion 11 is provided with a skirt 27 at an outer perimeter 29 and the skirt 27 extends beyond the grooved surface 15. A sealing flange 31 is provided on the grooved surface between adjacent cuts 33, 35, 37, 39 of the groove 17 and between the groove 17 and the skirt 27.

Figure 3:
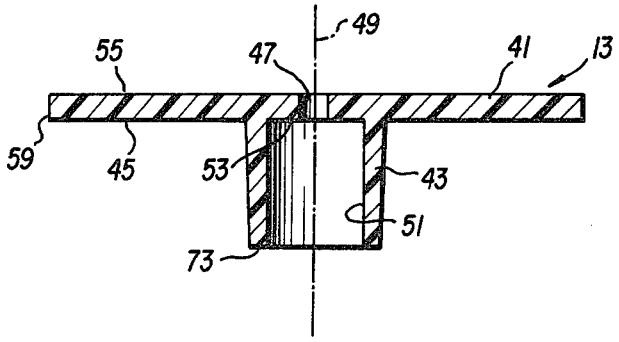
FIG. 3 is a longitudinal cross-sectional view of the lower half of an actuator embodied in the present invention.

Referring to FIG. 3, bottom portion 13 comprises a disc 41 with cylindrically shaped valve-engaging flange 43 extending from a bottom side 45 of disc 41. A restriction bore 47 is provided along a center axis 49 of the disc 41. The valve stem engaging flange 43 has an inner side 51 which is molded with a draft so that the diameter along the inner side 51 is smallest adjacent to the disc 41. However, the smallest diameter of the inner side 51 is greater than the diameter of the restriction bore 47. The valve stem engaging flange 43 is coaxial with restriction bore 47 so that the disc has a valve abutting surface 53 between the restriction bore 47 and the inner side 51 of the valve stem engaging flange 43. The bottom portion 13 has a top side 55, opposite the bottom side 45 which is relatively flat.

Figure 4:
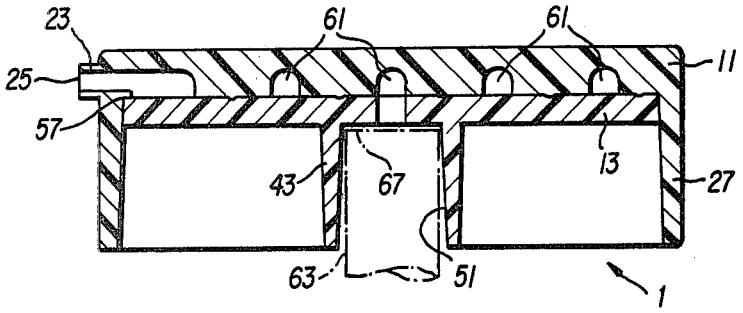
FIG. 4 is a longitudinal cross-sectional view of the assembled upper and lower halves of the actuator shown in FIGS. 2 and 3 the valve stem of the aerosol valve being shown in dotted line.

Referring to FIG. 4, the top and bottom portions 11 and 13 are ultrasonically bonded together so that the grooved surface 15 of the top portion 11 abuts the top side 55 of the bottom portion 13. The bonding contact between the top and bottom portions 11 and 13 occurs initially at the sealing flange 31, thereby preventing leakage of fluid from the groove 17. Additional sealing is provided at the intersection 57 between the outer diameter 59 of the disc 41 and the skirt 27. A spiral passageway 61 is formed by the top side 55 of the bottom portion 13 closing against the groove 17. If desired, the top side 55 may also be provided with a spiral groove (not shown) which complements and coincides with the spiral groove 17 when the top and bottom portions are assembled.

The center axis 21 of the top portion 11 coincides with the center axis 49 of the bottom portion 13. It can thus be seen that the restriction bore 41 aligns with the inlet end 19 and the passageway communicates fluid from the restriction bore 47 to the exit orifice 23.

Figure 5:
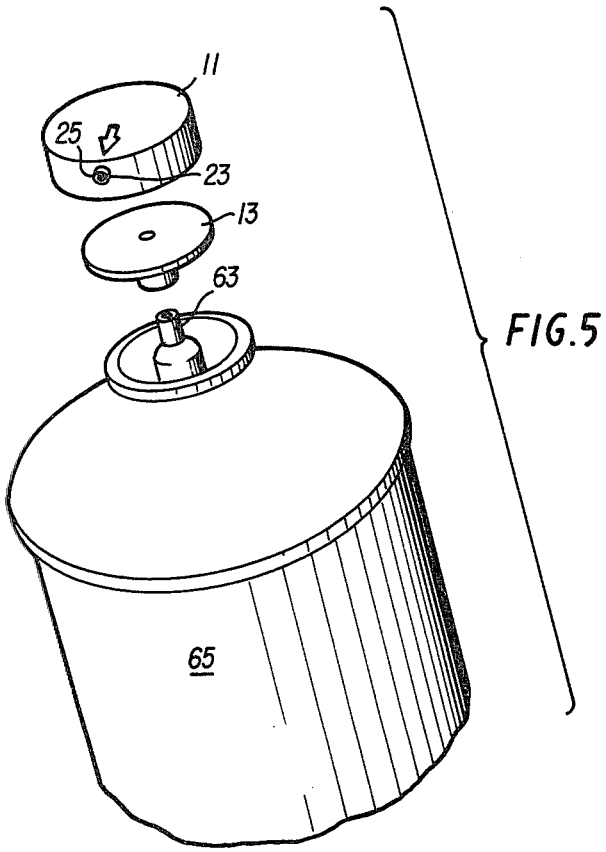
FIG. 5 is a partial exploded view, shown in perspective, showing the manner of assembling the upper and lower half of the actuator and the way this is mounted on the valve stem of the aerosol container.

As shown in FIGS. 4 and 5, the actuator body 1 is mounted on a conventional valve stem 63 of an aerosol valve of an aerosol container 65. The valve stem engaging flange 43 fits around the valve stem 63 and the valve abutting surface 53 may abut an uppermost part 67 of the valve stem 63. The actuator body 1 is dimensioned so that the inner side 51 of the valve stem engaging flange 43 provides an interference fit with the valve stem 63. Therefore, when the actuator 1 is pressed by the user, the contents of aerosol container 65 are expelled through the passageway 61 to exit at the exit bore 23 at the sidewall 25 of the top portion 11.

The passageway 61 acts as an expansion chamber in which an aerosol propellant is allowed to expand at a controlled rate before the contents of the aerosol container 65 exit the actuator body 1 as a soft spray. In a preferred embodiment, the restriction bore 47 provides a restriction which is greater than that of the exit orifice 23 to the atmosphere. Therefore, the exit velocity of the contents of the aerosol container from the sidewall 25 of the actuator body 1 is significantly less than the velocity at the restriction bore 47. This effectively reduces the breakup of the particles in the suspension and the "fogging" of the product and delivers an acceptable softer spray.

In a preferred embodiment, the groove 17 has a width of between 0.7 and 1.5 millimeters and a length of about 38 and 100 millimeters. The diameter of the inner side of the valve stem engaging flange 43 is between about 3 and 4 millimeters. The outside diameter of the top portion 11 and consequently of the actuator body 1 is between about 25 and 50 millimeters.

In the most preferred embodiment, the groove 17 has a maximum width of about 1.25 millimeters. The diameter of the inner side of the valve engaging flange 43 is about 3.8 millimeters and the diameter of the restriction bore 47 is about 1.2 millimeters. The length of the groove 17 is about 76 millimeters. The outside diameter of the top portion 11 and consequently of the actuator body 1 is about 27 millimeters.

The volume and length of the groove 17 may be varied, as well as the diameter of the restriction bore 47 and the cross-sectional area and shape of the exit bore 23. This will provide a variety of spray characteristics and patterns.

Several modifications to the preferred embodiment may be made. In one modification, a recess 71 is provided in the grooved surface 15 of the top portion 11. The recess 71 reduces the amount of plastic material used in the production of the actuator body 1. Other appropriate bonding means may be substituted for ultrasonic bonding. This includes the use of thermal bonding methods, solvent or snap engagement.

While the invention has been described in connection with an aerosol dispenser container with a valve and valve stem, the principals of the invention may be equally applied to the type of aerosol dispenser wherein an actuator/nozzle includes a stem which operate as a valve plunger. In that case, the valve engaging flange 43 acts as the stem and the bottom end 73 of the flange 43 engages the valve.

In use, when the actuator body is depressed, the valve is opened and a stream of the pressurized contents inside the container flows through the valve (generally through a tubular extension from the valve to near the bottom of the container) and valve stem, through the restriction, into the spiral passageway where expansion of the stream (propellant) occurs and then out the exit orifice where a soft aerosol spray is expelled into the ambient atmosphere.

While the sprayed particles may be projected as far in a horizontal direction (parallel to the ground) as with conventional nozzle bodies or spray heads, the particles will have a greater tendency to fall rapidly to the ground than with conventional nozzle bodies or spray heads which tend to provide finer sprays which may be suspended in the air.

As previously indicated, the novel actuator described above has special utility when used on an aerosol dispenser containing a suspension of particulate or powdered material in a hydrocarbon propellant system. It has particular application to systems which contain powdered active antiperspirant material suspended in a hydrocarbon propellant system and consequently, the more detailed description of this aspect of the invention will be described with respect to such antiperspirant systems.

The active antiperspirant material that may be employed in the present invention may be any one of a number of materials known in this art to exhibit this property which may be prepared as a powdered material capable of being suspended in the fluid medium in accordance with the present invention. By way of examples, we mention aluminum chlorhydroxide, aluminum chloride, aluminum chlorohydrex propylene glycol complex, aluminum zirconium complexes, sodium aluminum chlorohydroxy lactate or mixtures thereof. Typical of the mixed active antiperspirant materials that may be employed herein are the aluminum chloride-aluminum chlorhydroxide powdered materials described in Canadian Pat. No. 958,338; said patent being incorporated herein by way of reference.

The quantity of antiperspirant material contained in the aerosol container in accordance with the present invention will vary somewhat. Ordinarily, this will be in the range of about 1.0 to about 40.0% and preferably between about 3.0 to about 35.0% by weight based on the total weight of the composition.

As previously indicated, because of environmental considerations, it is desirable to use a hydrocarbon propellant in the present invention. The hydrocarbon propellants that are useful herein are those that are well known in the art. These are the liquified normally gaseous aliphatic hydrocarbons i.e. those that are gaseous at ambient pressures and temperatures. Generally, these propellants should have a boiling point lower than about 75° F. and a vapor pressure from about 25 to 70 pounds per square inch gauge (psig) at 70° F., preferably between 30 and 40 pounds psig. A suitable vapor pressure can also be produced by blending two different propellants such as propane and isobutane. By way of illustrating those hydrocarbon propellants that are useful herein, mention may be made of n-butane, isobutane, propane, pentane, isopentane and mixtures thereof. However, the propellants of choice are isobutane and n-butane.

Although the hydrocarbon propellants described above are preferred in practicing the present invention, other types of propellants can be employed. Thus, the well-known liquified normally gaseous halogenated hydrocarbon and particularly, the chlorofluorohydrocarbons may be utilized herein. These include such materials as 1,2-dichloro-1,1,2,2-tetrafluoroethane (Freon 114); trichlorofluoromethane (Freon 11); dichlorodifluoromethane (Freon 12); trichlorofluoroethane (Freon 113); chlorodifluoroethane (Freon 142B); chlorodifluoromethane (Freon 22); methylene chloride and mixtures thereof.

The quantity of propellant that will be contained in the aerosol containers in accordance with the present invention may also vary somewhat. Usually, this will fall within the range of from about 20% to about 80% by weight based on the total weight of the composition in the aerosol container. In the preferred forms of this invention, the propellant will constitute between about 35% to about 65% by weight on the same weight basis.

It is also often desirable to provide an oily material, preferably a liquid, which will serve as a vehicle for suspending the powdered antiperspirant material employed herein. Aside from this function, the oily material will serve as an emollient to give the skin a good feel when the product is deposited on it from the aerosol can and serve as a means for retaining the active material at the site on which it is deposited. For the latter reasons, it is advantageous to employ oily materials that are not especially volatile under the conditions under which it is applied to the skin e.g. one that does not have a vapor pressure above about 1 mm. of Hg at body temperature. By way of illustration of the oily materials that may be employed herein, the following may be mentioned: liquid hydrocarbons (mineral oil); fatty acid monoesters (isopropyl myristate, isopropyl palmitate); diesters of dicarboxylic acids (diisopropyl adipate); polyoxyalkylene glycol esters (polypropylene glycol 2000 monooleate); propylene glycol diesters of short chain fatty acids ($C_8$–$C_{10}$) (Neobee M20); polyoxyethylene ethers ((polyoxyethylene (4) lauryl ether (Brij 30), polyoxyethylene (2) oleyl ether (Brij 92), polyoxyethylene (10) oleyl ether (Brij 96, Volpo 10)); polyoxypropylene cetyl ether (Procetyl); higher fatty alcohols (oleyl, hexadecyl, lauryl); propoxylated monohydric alcohol M.W. 880–930 (Fluid AP); silicone oils (dimethyl polysiloxane 10–1000 centistokes). Mixtures of the above liquids are equally suitable for the purposes of this invention.

The quantity of oily material that will be contained in the composition of the present invention may also vary somewhat depending on the results desired. For the most part, it will comprise from about 1.0% to about 50.0% by weight and preferably from about 5.0% to about 35.0% by weight based on the total weight of the composition.

It is also desirable to incorporate in the aerosol compositions of this invention suspending agents to further prevent caking of the powder and to enable redispersing the powder by simple agitation. A variety of materials may be used (alone or in combination) for this purpose, among which may be mentioned:

(a) Cab-O-Sil (Cabot Co.) (Fumed Silica)
(b) Bentone 34 or Bentone 38 (dimethyl dioctadecyl ammonium bentonite or hectorite, respectively)
(c) Veegum F (R. T. Vanderbilt Co.) (microfine magnesium aluminum silicate)
(d) Microthene (U.S.I.) (polyethylene powder)
(e) Metal soaps of fatty acids (e.g. powder aluminum stearate, aluminum octoate)

The quantity of suspending agent that will be contained in the present composition may also be employed over a range of concentrations. Usually, this will fall within the range of from about 0.25% to about 5.0% by weight based on the total weight of the composition. The preferred range for these materials, however, will be from about 0.5% to about 3.0% by weight based on the total weight of the composition.

In addition to the aforesaid ingredients, other auxilliary agents well known to those skilled in the art may be incorporated in the present composition in effective quantities. These additives include:

1. Antibacterial and antifungal agents such as hexachlorophene, quaternary nitrogen compounds (benzethonium chloride), benzoic acid, resorcinol monoacetate, chlorobutanol, Vancide 89RE, zinc omadine, etc.
2. Fragrance
3. Slip Agents (e.g. talc, zinc stearate)
4. Surfactants (e.g. Arlacel 80 sorbitan monooleate)
5. Pigments (e.g. titanium dioxide)
6. Fabric Damage Reducing Agents (e.g. urea, glycine)
7. Anticorrosion Agents: Gafac RM 510 (ethoxylated dinonyl phenyl mono and diester of phosphoric acid); Crodafos CAP (propoxylated cetyl mono and diesters of phosphoric acid); Epoxol 8-2B (epoxidized butyl esters of linseed oil fatty acids).

The following Examples are given to further illustrate the present invention. It is to be understood, however, that the invention is not limited thereto. Unless otherwise specified, the percentages are given as percent by weight.

EXAMPLE 1

| | % by Wt. |
|---|---|
| Aluminum chlorhydroxide powder | 20.0 |
| Bentone 38 | 1.0 |
| Isopropyl palmitate/ isopropyl myristate | 29.0 |
| Isobutane | 50.0 |
| | 100.0 |
| Concentrate | |
| Aluminum chlorhydroxide powder | 40.0 |
| Bentone 38 | 2.0 |
| Isopropyl palmitate/ isopropyl myristate | 58.0 |
| | 100.0 |
| Propellant | |

-continued

| | % by Wt. |
|---|---|
| Isobutane | 100.0 |

1.5 ounces of the concentrate were charged into an aerosol can [202×314]. This was then capped with an aerosol valve having a valve stem with an internal diameter of 2 millimeters. 1.5 ounces of the propellant were then pressure filled into the aerosol can.

An actuator having the structure described above and shown in FIGS. 1 to 4 above was mounted on the valve stem of the aerosol valve as described above. In this instance, the spiral passageway 61 of the actuator was 76 millimeters long and an average internal diameter of 1.25 millimeters. The inlet end of passageway 61 had an internal diameter of 1.2 millimeters and an outlet diameter of 1.25 millimeters.

In order to establish a quantitative comparison of the standard aerosol actuator and the spiral actuator in their ability to reduce fogging, the following experiment was conducted.

| Product Composition | % by Wt. |
|---|---|
| Aluminum chlorhydroxide powder | 11.0 |
| *Emollient 60 | 16.3 |
| Bentone 38 | 0.5 |
| Fragrance | 0.2 |
| Isobutane/n-Butane (85/15) | 72.0 |
| | 100.0 |

*mixture isopropyl palmitate, isopropyl myristate, isopropyl stearate 60/35/5

Figure 6:
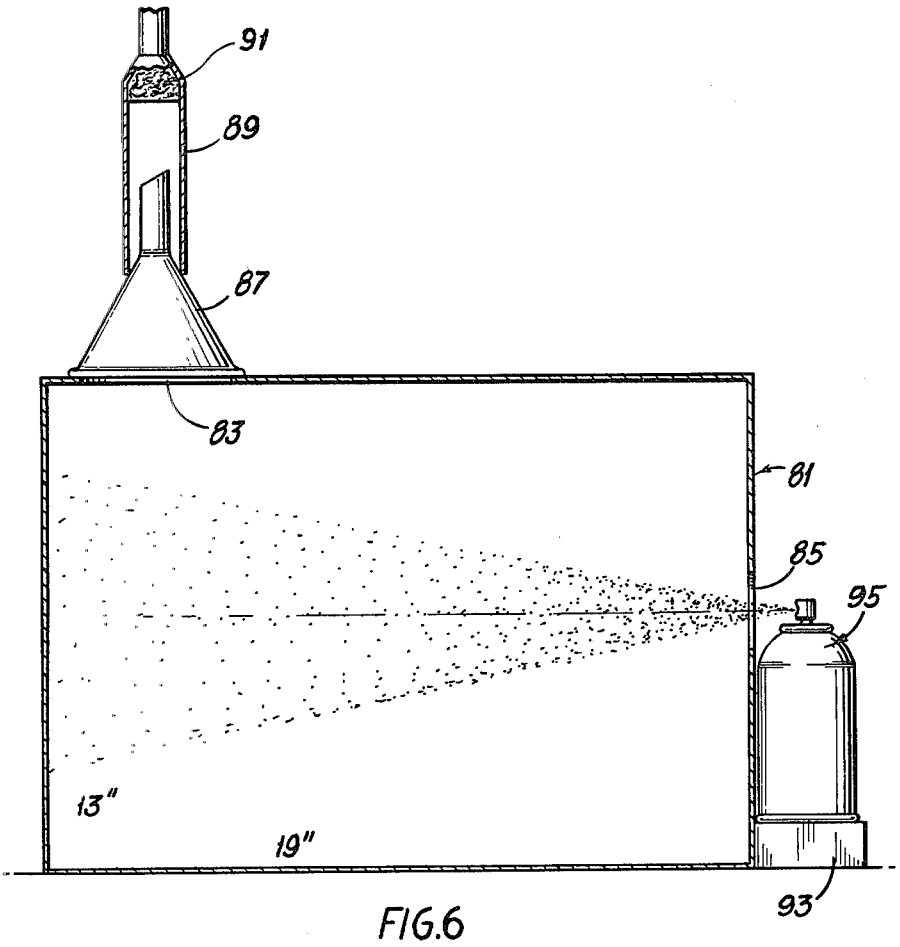
FIG. 6 is a diagrammatic representation of a spray chamber used in evaluating the "fogging" effect of the aerosol packages of the present invention.

Fill
5 oz. in 202×509 aerosol can
Valve- Precision Valve Co.
2×0.020 stem
0.062" body
0.030" vapor tap
0.040" capillary dip tube
Actuator
(a) Standard 0.020" orifice (01-6279-01)
(b) Spiral actuator 0.050" terminal orifice, 3" spiral A spray chamber shown generally at 81 in FIG. 6 was employed in the testing procedure. Spray chamber 81 is a rectangular enclosure having the dimensions 19"×13"×13". This is provided with a 4" diameter, exhaust opening 83 and a 2" diameter intake opening. A funnel 87 is mounted over exhaust opening 83 on which is disposed plastic tube 89. A cotton plug 91 is placed in the end of tube 89 and the outlet end of tube 81 is attached to a 10" vacuum pump. A step 93 is provided on which the test aerosol can 95 is rested during the testing procedure. The composition to be tested is placed in aerosol can 95 and the actuator button is depressed and directed so that the spray enters the spray chamber 81.

Test Procedure:

Place tared plastic tube with cottom plug over exhaust opening. Spray product through intake opening (4 second spray with standard actuator and 2 second spray with spiral actuator to deliver comparable amounts). Allow 10 seconds to elapse, apply 10" vacuum to plastic tube for 30 seconds. Reweigh tared tube to determine relative amount of airborne material in spray chamber.

Test Results:

| Standard Actuator | |
|---|---|
| Product Sprayed | Product Collected in Tube |
| 1.73 g | .0055 g |
| 1.73 g | .0051 g |
| 1.69 g | .0047 g |
| 1.75 g | .0058 g |
| 1.74 g | .0055 g |

Average collected per gram sprayed: 3.1 mg

| Spiral Actuator | |
|---|---|
| Product Sprayed | Product Collected in Tube |
| 1.95 g | .0000 g |
| 1.87 g | .0000 g |
| 1.75 g | .0000 g |
| 1.86 g | .0000 g |
| 1.94 g | .0000 g |

Average collected per gram sprayed: 0.0 mg

Although the invention has been described with reference to specific forms thereof, it will be understood that many changes and modifications may be made without departing from the spirit of this invention.

What is claimed is:

1. As an article of manufacture an aerosol container having incorporated therein under pressure particulate or powdered material suspended in a normally gaseous hydrocarbon propellant, said aerosol container being provided with a valve and an actuator; said actuator having a surface that engages said valve and a bore therethrough communicating at one end thereof with a fluid outlet in said valve, said actuator also being provided with an exit orifice; said actuator also being provided with a spirally shaped expansion chamber extending from said one end of said bore to said exit orifice whereby when said actuator is activated a controlled expansion of the propellant prior to entry of product into the ambient atmosphere is developed resulting in a low velocity spray with large particle size which tends to fall at a rapid rate rather than remain suspended in air.

2. An article of manufacture according to claim 1 in which the restriction of said bore is greater than the restriction of said exit orifice whereby the exit velocity of the contents of said aerosol container when said actuator is activated is less than at said exit orifice than the velocity of said contents through said bore.

3. An article of manufacture according to claim 2 in which the particulate or powdered material suspended in said hydrocarbon propellant is an antiperspirant material which is present in sufficient concentration to act as an effective antiperspirant.

4. An article of manufacture according to claim 3 wherein the quantity of antiperspirant material contained in said aerosol container is in the range of from about 1.0% to about 40.0% by weight based on the total weight of the composition in said container.

5. An article of manufacture according to claim 4 wherein the quantity of antiperspirant material contained in said container is in the range of from about 3% to about 35% by weight based on the total weight of the composition to said container.

6. An article of manufacture according to claims 1, 2, 3, 4 or 5 in which said hydrocarbon propellant is present in the range of from about 20% to about 80% by weight based on the total weight of the composition in said container.

7. An article of manufacture according to claims 1, 2, 3, 4 or 5 in which said hydrocarbon propellant is present in the range of from about 35% to about 65% by weight based on the total weight of the composition in said container.

8. An article of manufacture according to claims 1, 2, 3, 4 or 5 in which said hydrocarbon propellant is selected from the group consisting of n-butane, isobutane and mixtures thereof and said hydrocarbon propellant constitutes between about 20% and 80% by weight based on the total weight of the composition in the container.

* * * * *